US008297740B2

(12) United States Patent
Min et al.

(10) Patent No.: US 8,297,740 B2
(45) Date of Patent: Oct. 30, 2012

(54) HEAD CHIP USABLE WITH INKJET IMAGE FORMING APPARATUS AND MANUFACTURING METHOD OF THE SAME

(75) Inventors: Jae Sik Min, Suwon-si (KR); Ohyun Beak, Seoul (KR); Chang Shin Park, Seongnam-si (KR)

(73) Assignee: Samsung Electronic Co., Ltd., Suwon-si (KR)

( * ) Notice: Subject to any disclaimer, the term of this patent is extended or adjusted under 35 U.S.C. 154(b) by 1128 days.

(21) Appl. No.: 12/132,015

(22) Filed: Jun. 3, 2008

(65) Prior Publication Data

US 2009/0002455 A1 Jan. 1, 2009

(30) Foreign Application Priority Data

Jun. 27, 2007 (KR) ..... 10-2007-0063614

(51) Int. Cl.
*B41J 2/04* (2006.01)

(52) U.S. Cl. ..... 347/54; 29/890.1

(58) Field of Classification Search ..... 347/56, 347/54; 29/890.1
See application file for complete search history.

(56) References Cited

U.S. PATENT DOCUMENTS

| | | | | |
|---|---|---|---|---|
| 4,535,385 | A * | 8/1985 | August et al. | 361/711 |
| 5,856,836 | A * | 1/1999 | Silverbrook | 347/55 |
| 5,892,524 | A * | 4/1999 | Silverbrook | 347/15 |
| 5,905,517 | A * | 5/1999 | Silverbrook | 347/61 |
| 6,086,187 | A * | 7/2000 | Hattori et al. | 347/63 |
| 6,273,552 | B1 * | 8/2001 | Hawkins et al. | 347/48 |
| 7,207,641 | B2 * | 4/2007 | Komatsu et al. | 347/17 |
| 7,398,684 | B2 * | 7/2008 | Kimino | 73/514.38 |
| 7,666,260 | B2 * | 2/2010 | Iizuka | 118/726 |
| 2002/0008733 | A1 * | 1/2002 | Lee et al. | 347/48 |
| 2002/0121694 | A1 * | 9/2002 | Gaynes et al. | 257/738 |
| 2002/0139990 | A1 * | 10/2002 | Suehiro et al. | 257/99 |
| 2002/0175621 | A1 * | 11/2002 | Song et al. | 313/515 |
| 2003/0234833 | A1 * | 12/2003 | Kim | 347/62 |
| 2005/0052485 | A1 * | 3/2005 | Komatsu et al. | 347/17 |

(Continued)

FOREIGN PATENT DOCUMENTS

| | | |
|---|---|---|
| CN | 1883946 | 12/2006 |
| JP | 5004337 | 1/1993 |
| KR | 2006-133127 | 12/2006 |

OTHER PUBLICATIONS

European Search Report issued Oct. 23, 2008 in European Application No. 08156810.7.

(Continued)

*Primary Examiner* — Charlie Peng
*Assistant Examiner* — Peter Radkowski
(74) *Attorney, Agent, or Firm* — Stanzione & Kim, LLP

(57) ABSTRACT

A head chip for an inkjet image forming apparatus. The head chip can include a heater formed on a substrate to generate heat, a chamber layer formed on the heater and provided with an ink chamber that receives inks, a nozzle layer formed on the chamber layer and provided with a nozzle in correspondence with the ink chamber, and a heat transfer layer transferring a part of the heat from the heater to the nozzle. According to the head chip, the inks sprayed through the nozzle are heated by the heat transferred through the heat transfer layer. Thus, the viscosity of the inks is reduced, so that the inks can be easily cut into ink droplets having a substantially spherical shape.

6 Claims, 5 Drawing Sheets

U.S. PATENT DOCUMENTS

| | | | | |
|---|---|---|---|---|
| 2005/0134643 | A1* | 6/2005 | Cho et al. | 347/44 |
| 2005/0146552 | A1* | 7/2005 | Silverbrook | 347/20 |
| 2005/0223987 | A1* | 10/2005 | Iwata et al. | 118/715 |
| 2006/0290746 | A1* | 12/2006 | Kim | 347/67 |
| 2007/0101940 | A1* | 5/2007 | Iizuka | 118/726 |
| 2008/0023467 | A1* | 1/2008 | Sakurai et al. | 219/553 |
| 2008/0055367 | A1* | 3/2008 | Silverbrook | 347/61 |

OTHER PUBLICATIONS

Chinese Office Action issued May 20, 2010 in CN Application No. 200810177847.1.

Korean Office Action Issued on Feb. 20, 2012 in KR Patent Application No. 10-2007-0063614.

* cited by examiner

HEAD CHIP USABLE WITH INKJET IMAGE FORMING APPARATUS AND MANUFACTURING METHOD OF THE SAME

CROSS-REFERENCE TO RELATED APPLICATIONS

This application claims the benefit of Korean Patent Application No. 2007-63614, filed on Jun. 27, 2007, in the Korean Intellectual Property Office, the disclosure of which is incorporated herein by reference in its entirety.

BACKGROUND OF THE INVENTION

1. Field of the Invention

The present general inventive concept relates generally to a head chip usable with an inkjet image forming apparatus. More particularly, the present general inventive concept relates to a head chip usable with a thermal-driving type inkjet image forming apparatus and a manufacturing method thereof.

2. Description of the Related Art

In general, an inkjet image forming apparatus forms an image by spraying ink onto a printing medium such as a sheet. A head chip for a conventional inkjet image forming apparatus comprises a head chip for a thermal-driving type inkjet image forming apparatus disclosed in a Korean Unexamined Patent Publication No. 2006-133127, which comprises a substrate, a heater that generates heat, a chamber layer provided with an ink chamber that receives inks, and a nozzle layer provided with a nozzle for spraying the inks so as to generate bubbles in the ink of the ink chamber by the heat generated from the heater, thereby ejecting the ink from the nozzle by expansion force of the bubbles.

Since the inks used for the head chip for the conventional inkjet image forming apparatus are liquid with viscosity, ink droplets ejected through the nozzle have an elongated shape in the appearance of tails. Further, dots formed by the elongated ink droplets have an oval shape. Thus, a printed matter of high resolution may not be obtained through such oval-shaped dots.

SUMMARY OF THE INVENTION

The present general inventive concept provides an inkjet image forming apparatus capable of producing ink droplets having a substantially spherical shape.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept can be achieved by providing a head chip usable with an inkjet image forming apparatus including a heater formed on a substrate to generate heat, a chamber layer formed on the heater and provided with an ink chamber that receives inks, a nozzle layer formed on the chamber layer and provided with a nozzle in correspondence with the ink chamber, and a heat transfer layer transferring a part of the heat from the heater to the nozzle.

The heat transfer layer may include a first heat transfer section formed through the chamber layer and having a first end adjacent to the heater, and a second heat transfer section extending from a second end of the first heat transfer section to the nozzle.

The head chip may further include an adiabatic layer isolating the substrate from the heater, and a heater protection layer protecting the heater by covering the heater.

The head chip may further include an anti-cavitation layer that prevents corrosion due to heat and inks by forming a bottom surface of the ink chamber.

The first end of the first heat transfer section makes contact with the anti-cavitation layer.

Further, heat transfer holes can be formed through the chamber layer at both sides of the ink chamber of the chamber layer to form the first heat transfer section.

The foregoing and/or other aspects and utilities of the general inventive concept can be achieved by providing a manufacturing method of a head chip usable with an inkjet image forming apparatus, the method including forming a heater on a substrate, forming a chamber layer having an ink chamber, which receives inks, and heat transfer holes to transfer heat, which is generated from the heater, through the chamber layer, forming a first heat transfer section in the heat transfer holes such that heat is transferred through the chamber layer, forming a sacrificial layer in the ink chamber, forming a second heat transfer section, which receives the heat from the first heat transfer section, on the first heat transfer section and the sacrificial layer, forming a nozzle layer provided with a nozzle on the chamber layer and the second heat transfer section, and removing the sacrificial layer.

Further, after forming the adiabatic layer on the substrate, the heater is formed on an adiabatic layer.

Further, after forming a heater protection layer to protect the heater on the heater and forming an anti-cavitation layer for oxidation prevention on the heater protection layer, the chamber layer is formed on the anti-cavitation layer.

The foregoing and/or other aspects and utilities of the general inventive concept can be achieved by providing a head chip usable with an inkjet image forming apparatus including a heater formed on a substrate to generate heat; an ink flow region formed on the substrate to contain ink to be ejected; a nozzle layer formed above the ink flow region and provided with a nozzle in correspondence with the ink flow region; and a heat transfer layer to transfer a part of the heat from the heater to the nozzle.

The ink flow region contains ink therein and flows ink through the head chip to the nozzles.

The foregoing and/or other aspects and utilities of the general inventive concept can be achieved by providing a manufacturing method of a head chip usable with an inkjet image forming apparatus, the method including: forming a heater on a substrate; forming an ink flow region including heat transfer holes to transfer heat generated from the heater, therethrough; forming a first heat transfer section in the heat transfer holes such that heat is transferred through the ink flow region; forming a sacrificial layer in the ink flow region; forming a second heat transfer section to receive the heat from the first heat transfer section and extending across a portion of the sacrificial layer; forming a nozzle layer provided with a nozzle over the sacrificial layer and the second heat transfer section; and removing the sacrificial layer.

BRIEF DESCRIPTION OF THE DRAWINGS

The above and other objects, features and utilities of the present general inventive concept will be more apparent from the following detailed description taken in conjunction with the accompanying drawings, in which.

DETAILED DESCRIPTION OF THE PREFERRED EMBODIMENTS

Figure 1:
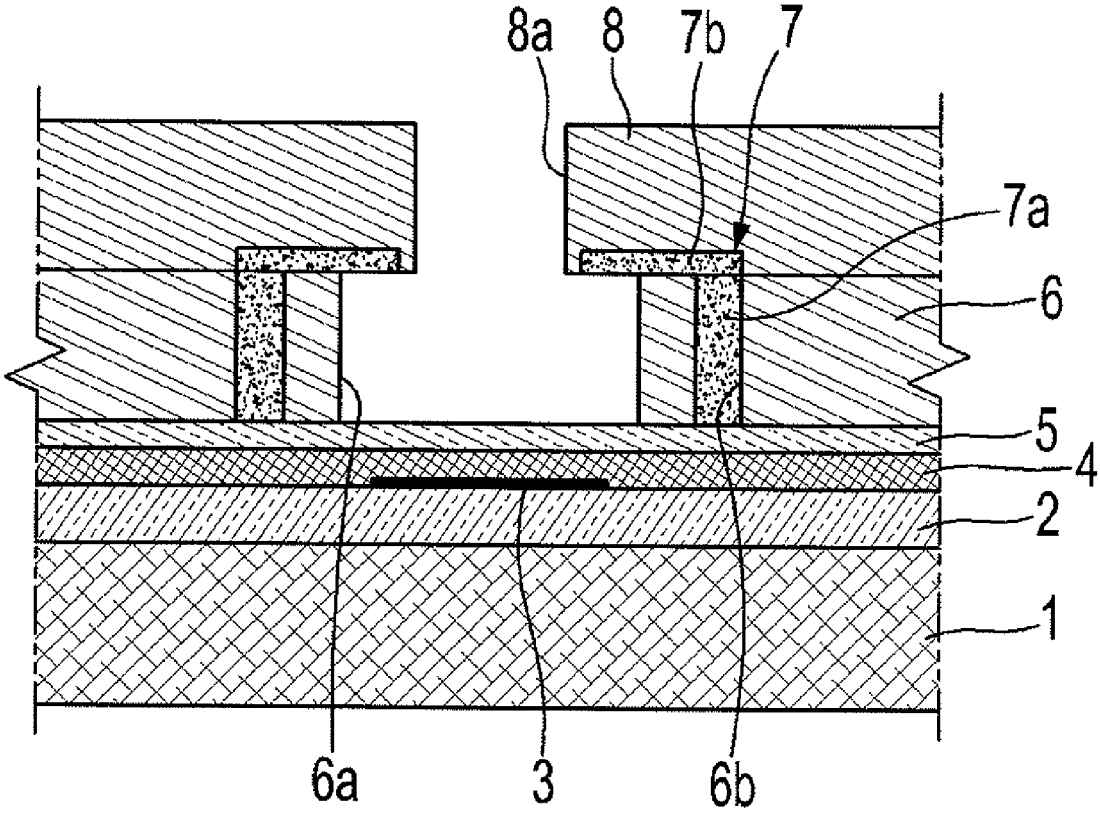
FIG. 1 is a sectional view illustrating a head chip of an inkjet image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

As illustrated in FIG. 1, a head chip usable with an inkjet image forming apparatus according to an embodiment of the present general inventive concept includes a silicon substrate 1, a heater 3 that generates heat by using supplied power, an adiabatic layer 2, a heater protection layer 4, an anti-cavitation layer 5, a chamber layer 6 and a nozzle layer 8. The adiabatic layer 2 is formed between the heater 3 and the substrate 1 to isolate the heater 3 from the substrate 1. The heater protection layer 4 is formed on the heater 3 to protect the heater 3. The anti-cavitation layer 5 includes metal material such as tantalum and can be formed on the heater protection layer 4 to prevent surface oxidation caused by heat or inks. The chamber layer 6 can be formed on the anti-cavitation layer 5 to form an ink chamber 6*a* that receives the ink. The nozzle layer 8 is formed on the chamber layer 6 and has an ink spray nozzle 8*a* corresponding to the ink chamber 6*a*. At this time, the chamber layer 6 provided with the ink chamber 6*a* is formed on the anti-cavitation layer 5, so that the anti-cavitation layer 5 forms the bottom surface of the ink chamber 6*a*.

Further, the head chip for the inkjet image forming apparatus according to the present embodiment includes a heat transfer layer 7 that heats the inks sprayed through the nozzle 8*a* by transferring the heat from the heater 3 to the nozzle 8*a*.

The heat transfer layer 7 has one end adjacent to the heater 3 to receive the heat generated from the heater 3, and the other end extending to the nozzle 8*a*. Thus, a part of the heat generated from the heater 3 is transferred to the nozzle 8*a*, so that the inks passing through the nozzle 8*a* can be heated. According to the present embodiment, the heat transfer layer 7 includes first heat transfer sections 7*a* and second heat transfer sections 7*b*. The first heat transfer section 7*a* is formed through the chamber layer 6 and has one end making contact with the anti-cavitation layer 5 to receive the heat generated from the heater 3. The second heat transfer section 7*b* extends to the nozzle 8*a* from the other end of the first heat transfer section 7*a*. At this time, heat transfer holes 6*b* formed through the chamber layer 6 are provided at both sides of the ink chamber 6*a* of the chamber layer 6, so that the first heat transfer sections 7*a* can be formed in the heat transfer holes 6*b* using photosensitive Ag paste.

A part of the heat generated from the heater 3 is transferred to the nozzle 8*a* through the heat transfer layer 7, so that the inks sprayed/ejected through the nozzle 8*a* are heated. Since viscosity of liquid is reduced proportionally to temperature of the liquid, the viscosity of the inks is also reduced, so that the inks sprayed through the nozzle 8*a* are cut with a short length due to low viscosity. In other words, ink droplets can be ejected to any size due to a low viscosity of the ink. Thus, ink droplets having a substantially spherical shape can be obtained. Consequently, dots approximate to a circle required for acquiring a printed matter of high resolution can be obtained.

Hereinafter, a manufacturing method of the head chip usable with the inkjet image forming apparatus having the construction as described above will be described, according to another embodiment of the present general inventive concept.

Figure 2:
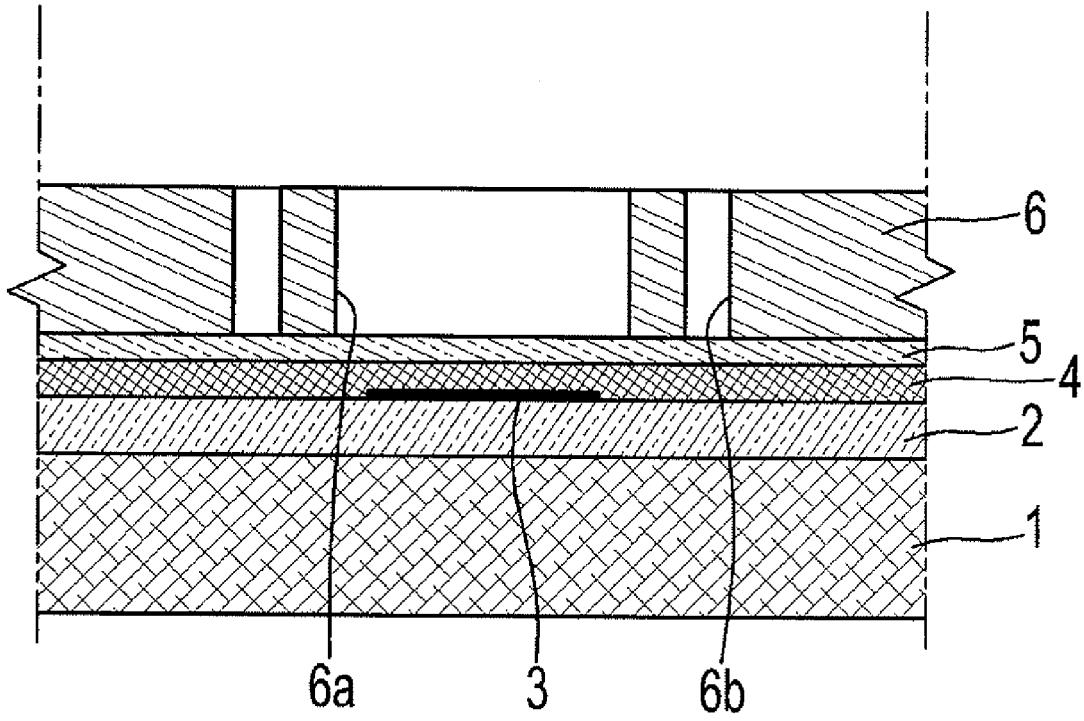
FIGS. 2 through 5 are sectional views illustrating a manufacturing method of a head chip for an inkjet image forming apparatus according to an embodiment of the present general inventive concept.
Figure 3:
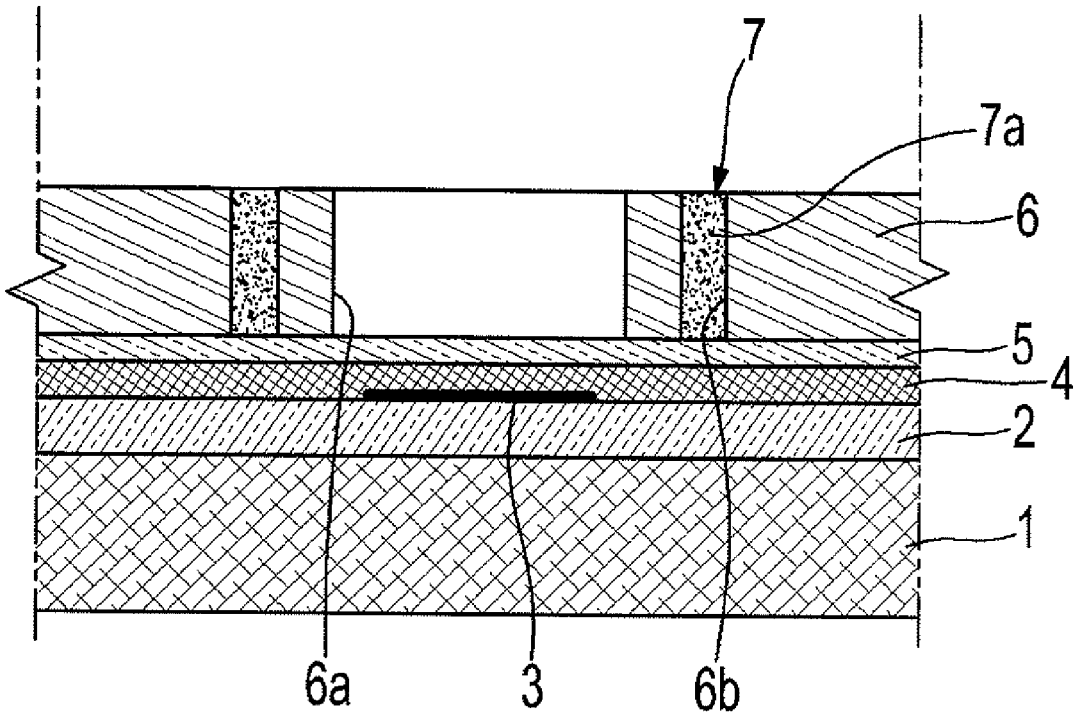
Figure 4:
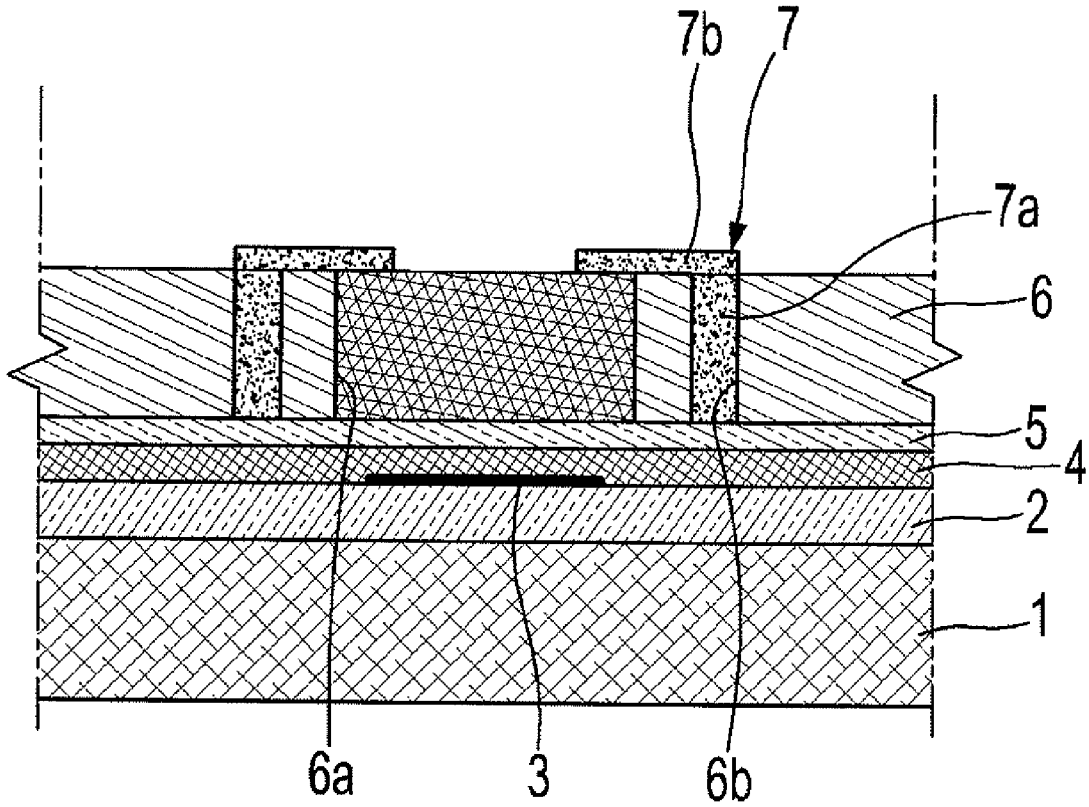
Figure 5:
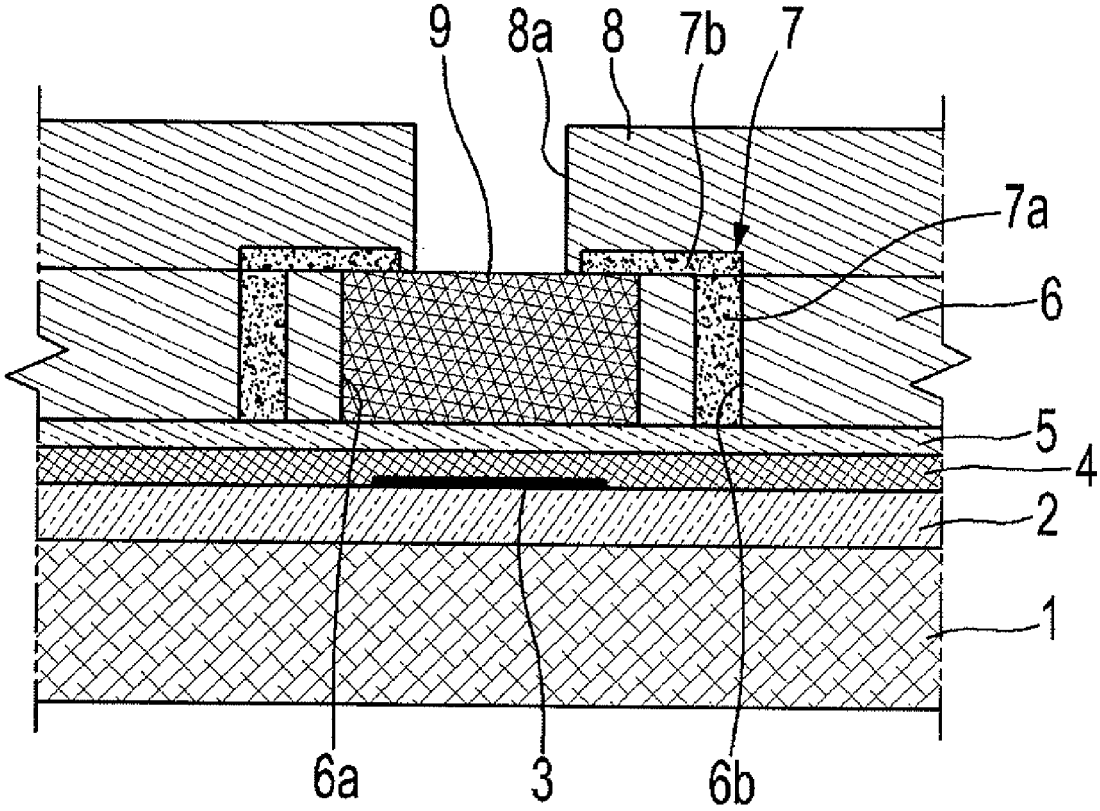

As illustrated in FIG. 2, after forming an adiabatic layer 2 comprising $SiO_x$ on a silicon substrate 1, a heater 3 is formed on the adiabatic layer 2 and a heater protection layer 4 including $SiN_x$ is formed on the heater 3. Then, an anti-cavitation layer 5 including tantalum is formed on the heater protection layer 4 to prevent oxidation, and a chamber layer 6 having an ink chamber 6*a* and heat transfer holes 6*b* is formed. As illustrated in FIG. 3, first heat transfer sections 7*a* of the heat transfer layer 7 are formed by filling photosensitive Ag paste in the heat transfer holes 6*b*. As illustrated in FIG. 4, after filling the ink chamber 6*a* with a sacrificial layer 9 to be removed, second heat transfer sections 7*b* of the heat transfer layer 7 are formed on the first heat transfer sections 7*a* and the sacrificial layer 9. As illustrated in FIG. 5, a nozzle layer 8 provided with a nozzle 8*a* is formed on the chamber layer 6 and the second heat transfer section 7*b*, and the sacrificial layer 9 is finally removed from the ink chamber 6*a*, thereby completing fabrication of the head chip for the inkjet image forming apparatus as illustrated in FIG. 1.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A manufacturing method of a head chip usable with an inkjet image forming apparatus, the method including:

forming a heater on a substrate;

forming a chamber layer having an ink chamber, which receives inks, and heat transfer holes for transferring heat, which is generated from the heater, through the chamber layer;

forming a first heat transfer section in the heat transfer holes such that heat is transferred through the chamber layer;

forming a sacrificial layer in the ink chamber;

forming a second heat transfer section, which receives the heat from the first heat transfer section, on the first heat transfer section and the sacrificial layer;

forming a nozzle layer provided with a nozzle on the chamber layer and the second heat transfer section; and removing the sacrificial layer, wherein the second heat transfer section extends from the first heat transfer section toward the nozzle.

2. The method as claimed in claim 1, wherein, after forming an adiabatic layer on the substrate, the heater is formed on the adiabatic layer.

3. The method as claimed in claim 1, wherein, after forming a heater protection layer for protecting the heater on the heater and forming an anti-cavitation layer for oxidation prevention on the heater protection layer, the chamber layer is formed on the anti-cavitation layer.

4. The method as claimed in claim 1, wherein the first heat transfer section includes a photosensitive metallic paste and the forming of the first heat transfer section includes filling the heat transfer holes with the photosensitive metallic paste.

5. The method as claimed in claim 4, wherein the photosensitive metallic paste is a photosensitive Ag paste.

6. The method as claimed in claim 1, wherein the heat received from the first heat transfer section by the second heat transfer section is transferred to the nozzle of the nozzle layer via the second heat transfer section.

* * * * *